United States Patent [19]

Mueller et al.

[11] Patent Number: 4,552,279

[45] Date of Patent: Nov. 12, 1985

[54] CONTAINER CLOSURE

[75] Inventors: Bruce M. Mueller, Sylvania, Ohio; Zbignew Swierczek, Temperance, Mich.

[73] Assignee: Owens-Illinois, Inc., Toledo, Ohio

[21] Appl. No.: 650,490

[22] Filed: Sep. 14, 1984

[51] Int. Cl.[4] ..... B65D 41/22

[52] U.S. Cl. ..... 215/318; 215/346

[58] Field of Search ..... 215/318, 346

[56] References Cited

U.S. PATENT DOCUMENTS

| | | | |
|---|---|---|---|
| 3,371,813 | 3/1968 | Owen et al. | 215/318 |
| 3,690,497 | 9/1972 | Lecinski | 215/318 |
| 4,452,365 | 6/1984 | Ascasibar-Verdejo | 215/346 |

FOREIGN PATENT DOCUMENTS

| | | | |
|---|---|---|---|
| 2453963 | 12/1975 | Fed. Rep. of Germany | 215/318 |

*Primary Examiner*—Donald F. Norton
*Attorney, Agent, or Firm*—John R. Nelson

[57] ABSTRACT

A container closure adapted to be applied to a container having threads by an axial movement and to be removed by a rotary movement to open the container comprising a body including a base wall and a peripheral wall and a gasket of plastic material formed in situ along the peripheral wall and at least a portion of the base wall which is adapted to overlie the end of the container. The surface of an annular portion of the gasket along the peripheral wall is formed with a plurality of circumferentially extending substantially flat surfaces such that it has a polygonal configuration in transverse cross section with axially extending channels at the junctures of the substantially flat surfaces. When the closure is applied to the container, the threads on the container deform the surfaces of the polygonal portion by indentation to define complementary threads therein. When the closure is being applied, the channels permit gases in the head space of the container to escape so that excessive pressurization tending to force the cap off does not occur. After the closure is applied to the container, the channels provide areas into which the plastic material may cold flow to release excessive compressive stresses which develop during shelf life of the package comprising the closure and container, thereby resulting in lower removal torques.

8 Claims, 7 Drawing Figures

CONTAINER CLOSURE

This invention relates to container closures and particularly closures having gaskets formed in situ therein.

BACKGROUND AND SUMMARY OF THE INVENTION

One common type of container package comprises a container closure having a base wall and a peripheral wall, commonly made of metal or plastic, which has a gasket of vinyl plastisol cast in situ and extending along the peripheral wall and at least a portion of the base wall to overlie the end of the container. Such a closure is applied by forcing it axially onto a container having threads and the threads on the container deform the gasket by indentation of the container threads into the gasket so that when the gasket is rotated counterclockwise relative to the containers, the closure is removed to provide access to the contents.

One common problem with respect to such packages of a container and closure is that the packages are subjected to cold flow of the gasket material during the shelf life on the package which may comprise two to three years. In the prior art designs, the gasket has uniform thickness around the periphery of the closure and there is a tendency for the gasket material to produce high compressive stresses which result in high removal torques. The removal torques increase as the shelf life of the package increases.

Another problem that occurs where the contents being packaged are hot is the tendency of the hot gases in the head space above the contents to cause a high pressure tending to force the closure off the container at least until the container cools.

In U.S. Pat. No. 3,371,813, it is proposed to provide circumferentially spaced and radially extending ribs on the gasket which are tapered radially inwardly toward the top panel of the closure and engage the threads on the container. Such ribs function to decrease the removal torque by reducing the area of contact but are difficult to form and control.

Accordingly, among the objectives of the present invention are to provide a closure wherein highly stressed areas can be relaxed resulting in lower removal torques; wherein the hot gases can be vented during application of the closure to prevent the pressure from forcing the closure off the container; and wherein the areas of the thread contacting surfaces of the gasket are easily controlled.

In accordance with the invention, the container closure is adapted to be applied to a container having threads by an axial movement and to be removed by a rotary movement to open the container comprising a body including a base wall and a peripheral wall and a gasket of plastic material formed in situ along the peripheral wall and at least a portion of the base wall which is adapted to overlie the end of the container. The surface of an annular portion of the gasket along the peripheral wall is formed with a plurality of circumferentially extending substantially flat surfaces such that it has a polygonal configuration in transverse cross section with axially extending channels at the junctures of the substantially flat surfaces. When the closure is applied to the container, the threads on the container deform the surfaces of the polygonal portion by indentation to define complementary threads therein. When the closure is being applied, the channels permit gases in the head space of the container to escape so that excessive pressurization tending to force the cap off does not occur. After the closure is applied to the container, the channels provide areas into which the plastic material may cold flow to release excessive compressive stresses which develop during shelf life of the package comprising the closure and container, thereby resulting in lower removal torques.

DESCRIPTION

Figure 1:
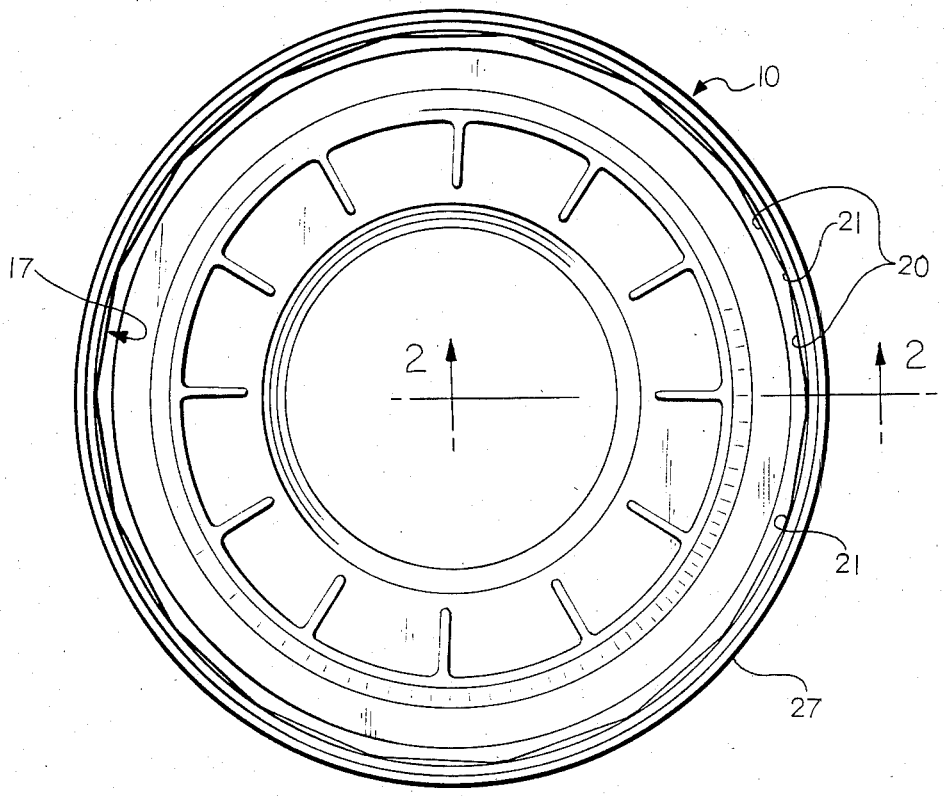
FIG. 1 is a bottom plan view of the container closure embodying the invention.
Figure 2:
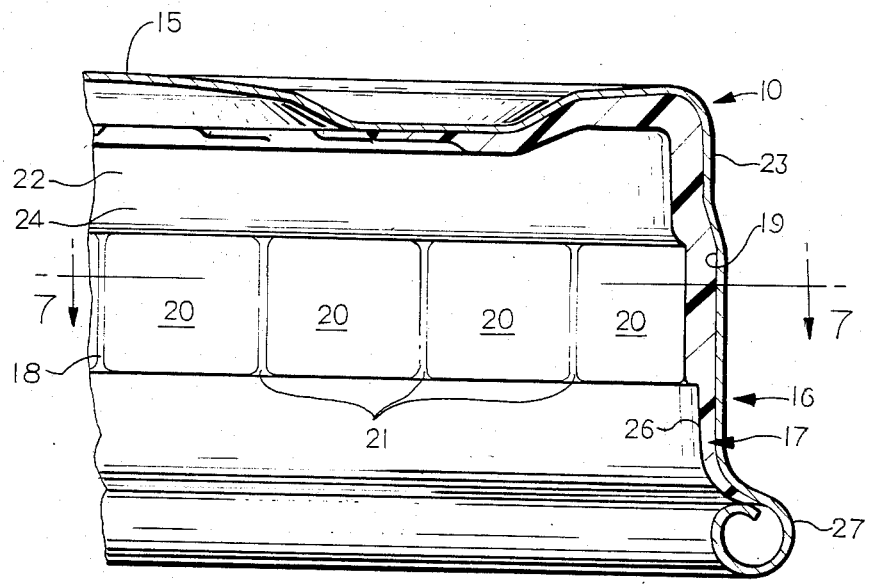
FIG. 2 is a part sectional elevational view of a container closure taken along the line 2—2 in FIG. 1.
Figure 3:
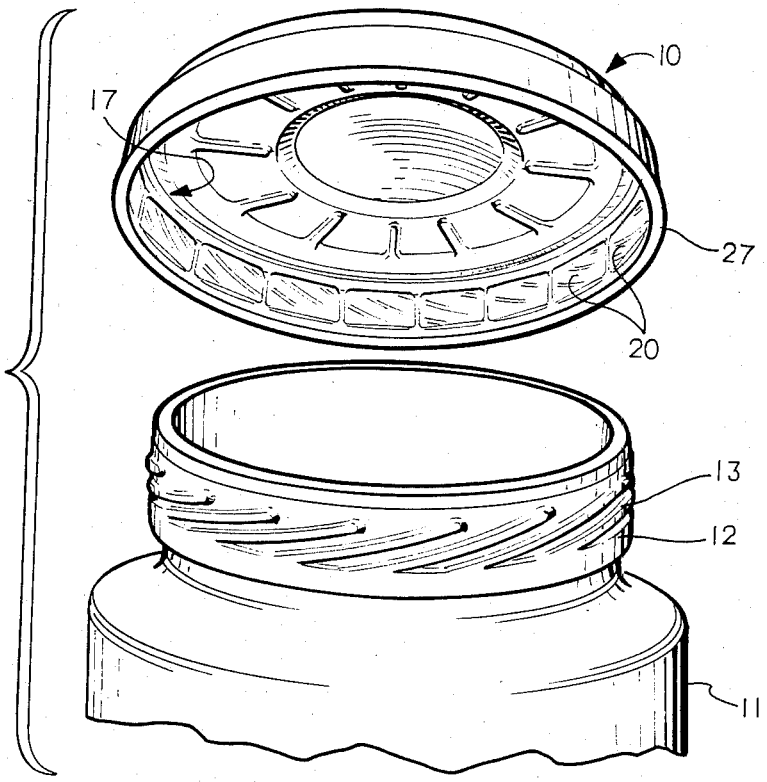
FIG. 3 is an enlarged perspective view of the closure and container.

Referring to the drawings, the container closure 10 embodying the invention is intended to be utilized with a conventional container 11 having an open end or finish 12 with plural threads 13 on the periphery thereof. The container is preferably made of glass or rigid plastic material.

The container closure 10 is made of metal and includes a base wall 15 and a peripheral wall or skirt 16 having a rolled flange at its free end. A gasket 17 of foamed vinyl plastisol material or similar plastic material is cast in situ and extends along the peripheral wall and a portion of the base wall at the area of juncture of the base wall 15 and peripheral wall 16 which overlies the end 12 of the container 11.

In accordance with the invention, an annular portion 18 of the gasket 17 has its outer surface contacting the outer surface of the corresponding cylindrical portion 19 of the peripheral wall 16 and its inner surface formed with a plurality of substantially flat surfaces 20 such that the inner surface has a polygonal configuration in transverse cross section. The surfaces 20 lie in axial planes parallel to the axis of the closure and form axially extending channels 21 at the junctures of the surfaces.

Figure 7:
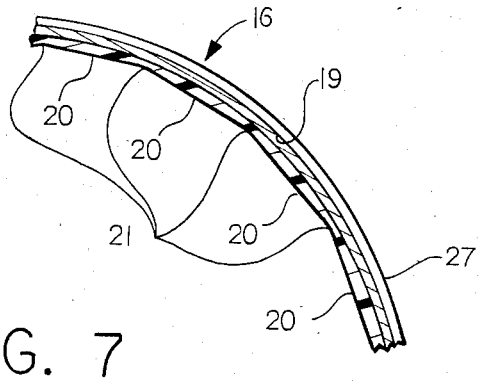
FIG. 7 is a fragmentary sectional view taken along the line 7—7 in FIG. 2.

As shown in FIG. 7, each segment of the gasket defined by each substantially flat surface 20 and the arcuate outer surface increases in thickness from the channels 21 circumferentially toward the center of the segment. The polygonal inner surface comprises at least fifteen surfaces 20 and preferably eighteen surfaces.

The peripheral portion of gasket 17 further includes an annular portion 22 between the polygonal portion 20 and the base portion. Portion 22 has an outer surface defined by a cylindrical portion 23 of the peripheral wall 16 of the closure and a cylindrical inner surface 24 which is adapted to seal against a frustoconical outer surface 25 on the finish of the container above the threads 13. The diameter of surface 25 is less than the diameter of the cylinder defined by surfaces 20. The peripheral portion of the gasket further includes a cylindrical surface 26 below the surfaces 20 which extends to the rolled edge 27 of the closure which has a diameter substantially equal to the cylinder defined by the apices of channels 21.

The gasket is formed by conventional methods by flowing the wet plastisol into the inverted closure and spinning the closure to cause the plastisol to flow along the peripheral wall 16. A heated plunger is then forced axially into the closure while the closure is on a heated plate. The plunger has the configuration which corresponds to the annular surfaces 22, 20, 25 of the gasket, namely, a cylindrical surface, a polygonal surface and a cylindrical surface. The heated plunger is removed and the closure is then heated in an oven to cure the plastisol. As is well known in the art, during curing, the plastisol expands or puffs slightly so that the flat surfaces and channels are slightly less sharply defined due to nature of the material. The expansion or puffing is usually greater. This invention does not rely on a change in dimension by expansion or puffing.

Figure 4:
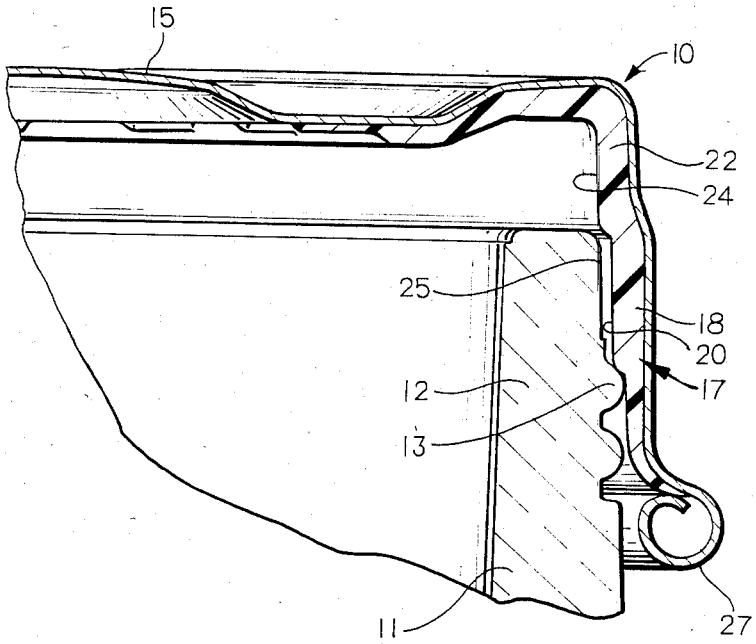
FIGS. 4–6 are fragmentary sectional views on an enlarged scale of the closure and container during successive stages of application of the closure to the container.
Figure 5:
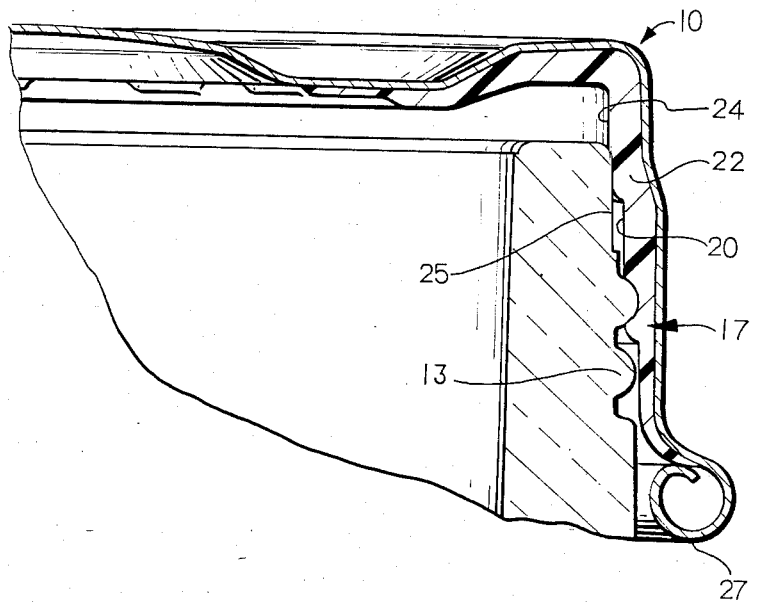
Figure 6:
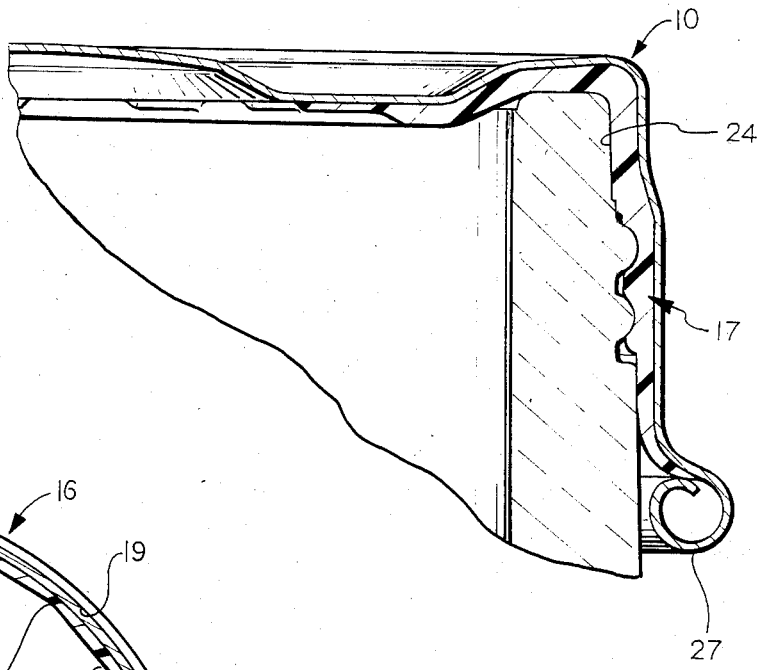

Referring to FIGS. 4, 5 and 6, as the closure is applied to the container, the surfaces 20 on the annular portion 18 first engage the threads 13 (FIG. 4). On continued movement of the closure axially downwardly viewed in FIG. 5, the surface 24 of annular portion 22 engages the surface 25 on the finish of the container. Finally, the closure is brought to the position shown in FIG. 6 wherein the base portion of the gasket engages the top surface of the container to provide the final seal. If the contents are heated, subsequent cooling of the contents causes a vacuum in the head space drawing the closure in even tighter relationship with the surface on the finish.

When the container closure 10 is applied by axial movement on the container 11 to close the container 11 and its contents, the channels 21 define areas of virtually no compressive stress when the closure 10 is on the finish 12 so that the highly stressed sections of the gasket 17 around the periphery can relax by cold flow toward the no-stress areas 21. This results in a lower removal torque.

The gasket design permits cold flow of the gasket material during the normal shelf life which can comprise two to three years and prevents high torques from occurring during the shelf life. The provision of the flat surfaces provides for a more accurate control of the torque since the surfaces are easier to form and accommodate the tolerances in the finish of the container. In addition, the tools for making the gasket are easier to make. In order to change the removal torque, the number of flat surfaces may be changed as well as the size of the cylinder circumscribed by the flat surfaces.

It has been found that the container closure provides the desired results where the package is not retorted as well as where the package is retorted.

We claim:

1. A container closure adapted to be applied to a container having threads by an axial movement and to be removed by a rotary movement to open the container comprising a body including a base wall and a peripheral wall, and a gasket of plastic material formed in situ along the peripheral wall and at least a portion of the base wall which is adapted to overlie the end of the container, an annular portion of the gasket along the peripheral wall being formed with a plurality of circumferentially extending substantially flat surfaces such that it has a polygonal configuration in transverse cross section with axially extending channels at the junctures of the substantially flat surfaces such that when the closure is applied to the container, the threads on the container deform the surfaces of the polygonal portion by indentation to define complementary threads therein, and when the closure is being applied, the channels permit gases in the head space of the container to escape so that excessive pressurization tending to force the cap off does not occur and after the closure is applied to the container, the channels provide areas into which the plastic material may cold flow to release excessive stresses which develop during shelf life of the package comprising the closure and container, thereby resulting in lower removal torques.

2. The container closure set forth in claim 1 wherein said gasket includes a second annular portion interposed between the first mentioned annular portion and the portion along the base wall of the closure.

3. The container closure set forth in claim 2 wherein said second annular portion includes an inwardly facing cylindrical surface having a diameter smaller than the diameter of the cylinder defined by the flat surfaces of the first mentioned annular portion.

4. The container closure set forth in claim 2 wherein said gasket includes a third annular portion between the first mentioned annular portion and the edge of the peripheral wall of the closure.

5. The container closure set forth in claim 4 wherein the diameter of the inwardly facing surface of the third mentioned annular portion is substantially equal to the diameter containing the apices of the channels in the first mentioned portion.

6. The container closure set forth in claim 1 wherein the configuration of said portion containing said flat surfaces in transverse cross section comprises a plurality of segments, each segment including an arcuate outer surface defined by the corresponding portion of the closure such that the segment decreases in cross section from the center thereof toward the circumferential ends thereof at the channels.

7. The container of closure set forth in claim 1 wherein said surfaces comprise at least fifteen surfaces.

8. The container closure set forth in claim 1 wherein the container closure comprises eighteen surfaces.

* * * * *